United States Patent [19]

Valencia

[11] Patent Number: 4,587,773

[45] Date of Patent: May 13, 1986

[54] SEISMIC PROTECTION SYSTEMS

[76] Inventor: Hector A. Valencia, Cerro Gordo 44, Mexico 21. DF., Mexico

[21] Appl. No.: 722,409

[22] Filed: Apr. 12, 1985

Related U.S. Application Data

[63] Continuation-in-part of Ser. No. 457,582, Jan. 13, 1983, abandoned.

[51] Int. Cl.[4] ..... E04H 9/00
[52] U.S. Cl. ..... 52/1; 52/167
[58] Field of Search ..... 52/1, 167

[56] References Cited

U.S. PATENT DOCUMENTS

| | | | |
|---|---|---|---|
| 3,203,141 | 8/1965 | Masser | 52/1 |
| 3,232,012 | 2/1966 | Proctor | 52/1 |
| 3,468,080 | 9/1969 | Hansen | 52/1 |
| 3,538,653 | 11/1970 | Meckler | 52/1 |
| 4,098,034 | 7/1978 | Howell | 52/1 |

FOREIGN PATENT DOCUMENTS

| | | | |
|---|---|---|---|
| 258785 | 3/1984 | U.S.S.R. | 52/1 |

OTHER PUBLICATIONS

Architectural Record, Jun. 1978, pp. 114–116.

*Primary Examiner*—Henry E. Raduazo
*Attorney, Agent, or Firm*—Roylance, Abrams, Berdo & Goodman

[57] ABSTRACT

A seismic protection system for a structure includes a foundation plate with retaining walls for supporting and isolating the structure from the ground, and oscillatory, vibratory and hydro-pneumatic arrangements for movably coupling the structure to the foundation plate and retaining walls. The oscillatory arrangement permits horizontal movement between the structure and foundation plate and contains fluid. The vibratory arrangement is coupled to the oscillatory arrangement for relative vertical movement of the structure and for dampening and transferring loads on the structure to the oscillatory arrangement. The hydro-pneumatic arrangement has a surge chamber, and permits and controls movement between the structure and the retaining walls. A wind driven pressure generator mounted on the structure is coupled to the oscillatory, vibratory and hydro-pneumatic arrangements to coordinate their action in response to wind driven structure movements.

13 Claims, 28 Drawing Figures

FIG.10
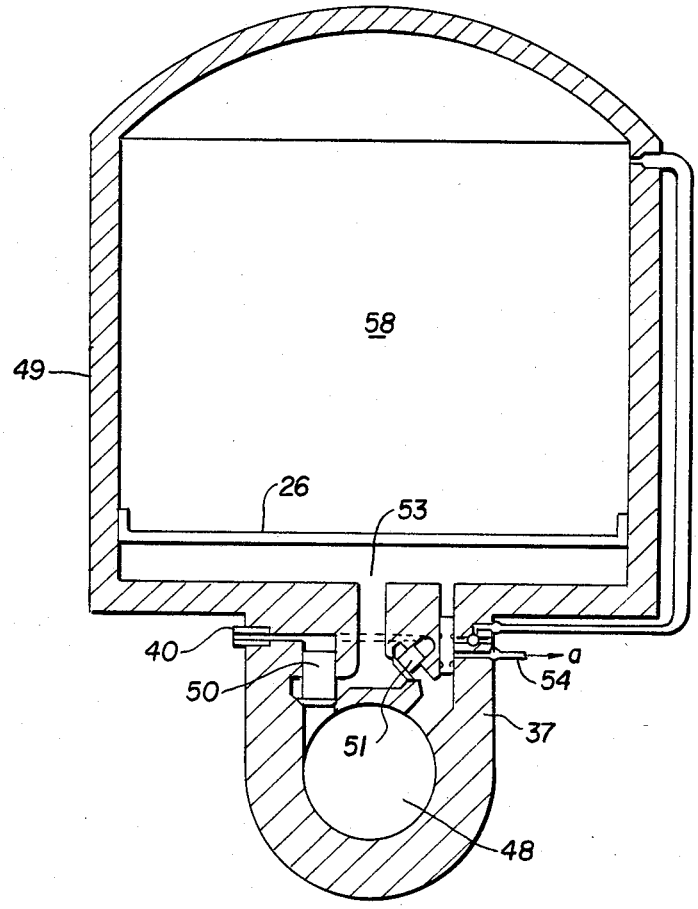
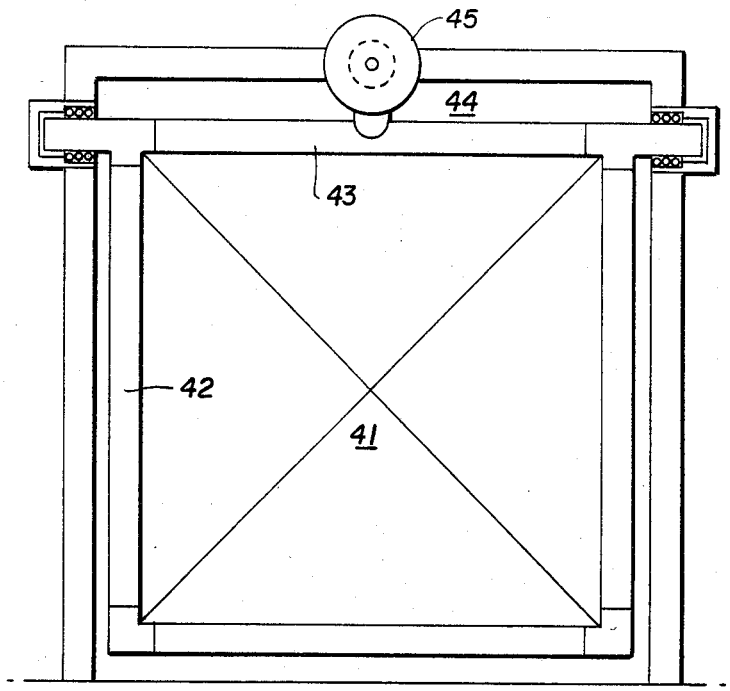
FIG.21

SEISMIC PROTECTION SYSTEMS

REFERENCE TO RELATED APPLICATION

This application is a continuation-in-part of co-pending U.S. application Ser. No. 457,582, filed Jan. 13, 1983 and it incorporates by reference the entire disclosure of that parent application 457,582, which is now abandoned.

BACKGROUND AND PRIOR ART

Earthquakes produce undulatory movements of the earth's crust which rebound on everything supported thereon. Consequently, a considerable percentage of the cost of structures, at least in earthquake prone areas such as Mexico City, Japan, San Francisco, etc., is used to reinforce such buildings in order to make them resist seismic accelerations and the forces resulting therefrom.

In anti-seismic calculus, it is considered that the structure is supported on and embedded in the ground and that an earthquake creates movements having horizontal components (oscillatory) and vertical components (vibratory). In structures, the first of these types of movements becomes or turns into tensile, compressive and shear stresses. The second type causes increases in vertical stresses. In both cases, a certain degree of acceleration is foreseen according to the specific seismic area on which a building is going to be erected and the use to be made of the structure. Should an earthquake producing higher accelerations then those that were calculated occur, the building could be severely damaged or completely destroyed. But even in cases where seismic magnitudes are kept within such limits, they cause large material, and above all, human losses.

Several attempts have been made to isolate structures from earthquakes. In some cases, the accelerations and forces are dampened or absorbed to a certain extent, and in other instances the proposed systems have not been accepted due to the fact that they are impractical or uneconomical. The present invention has found an economic way to minimize oscillatory effects to a point that they become hardly perceptible, and vibratory effects are brought to an acceptable level (depending on the characteristics of the structure itself), regardless of the intensity of the earthquake. The invention is applicable to any kind of construction, regardless of its shape, size, height and weight. Furthermore, the invention has the additional advantages in that it solves the problem of differential sinking of the ground, and that it acts as an energy disperser in the event of an explosion, both conventional or atomic. It can also be used in other unrelated environments, for example, as a rotary support for radar antennas, and the like.

Basically, the invention removes friction between the ground and the structure, transferring the structure stresses to the ground through a fluid that is hermetically confined and which, therefore, can withstand the pressures applied thereto without presenting any resistance other than the viscosity of the fluid to relative displacements between the applicating (driving) and the receiving (driven) elements. Friction removal makes it possible for the structure to slide by any external force such as wind, explosions, etc. It is advantageous that this happens in the case of explosions because there is any energy dispersion which avoids or prevents greater damage, but it is imperative to prevent any displacement by the action of the wind. The solution to this problem brings about the creation of a couple of forces:

that of the wind, and the reaction to counteract it. This couple of forces, multiplied by their leverage, will produce an overturning moment which also has to be balanced. These problems are considered and solved by the present invention.

BRIEF DESCRIPTION OF THE DRAWINGS

These and other features of the invention will be better understood by means of the following description taken together with the drawings wherein:

FIG. 10 is a cross-section of a hydro-pneumatic jack;

FIGS. 20 and 21 are, respectively, a cross-section and a longitudinal section of the pressure generator;

DETAILED DESCRIPTION OF THE INVENTION

This invention comprises the following elements: an oscillatory element, a vibratory element, a wind driven pressure generating element, a friction element and hydro-pneumatic jacks with a surge chamber. More specifically, 1 is the structure; 2 are the foundations; 3 is the retaining wall; 4 is the natural ground; 5 are the horizontal displacement elements; 6 are the vertical displacement elements; 7 are the hydro-pneumatic jacks with surge chambers; and 8 are pressure generators driven by the wind.

Figure 4:
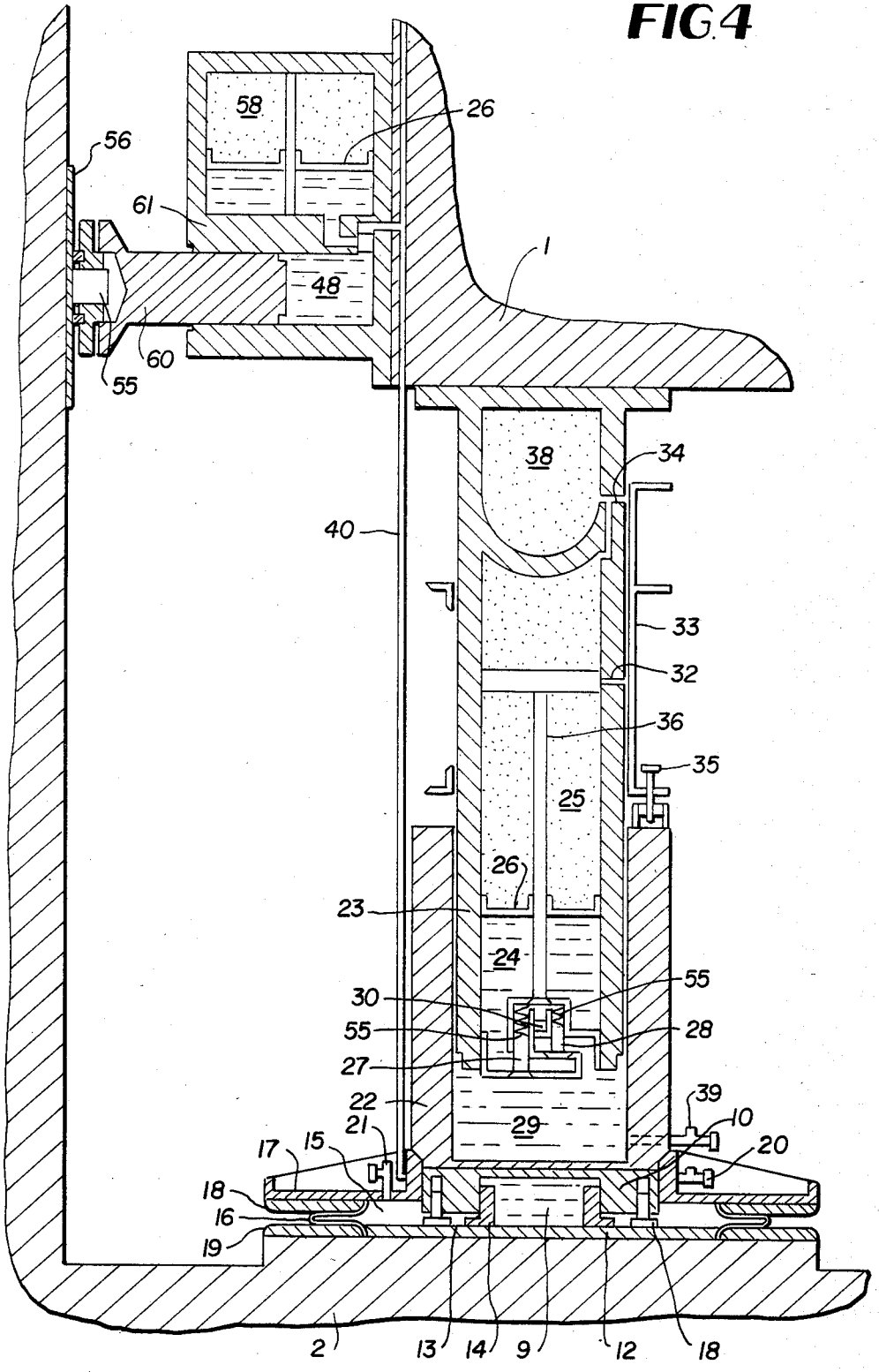
FIG. 4 is a vertical section of the oscillatory, vibratory and friction elements, as well as of a hydro-pneumatic jack with a surge chamber.
Figure 5:
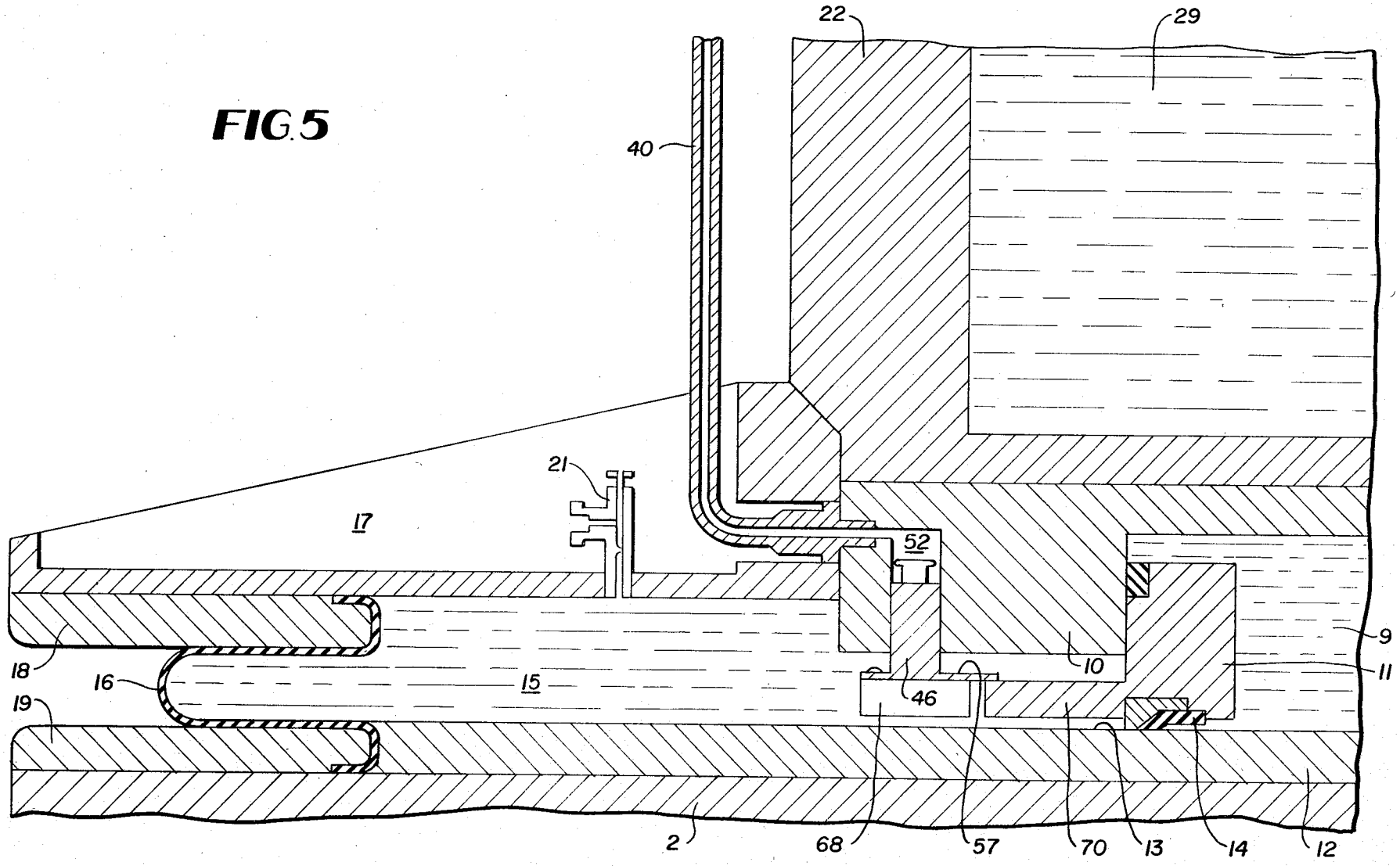
FIG. 5 is a cross-sectional view of the oscillatory elements.

The oscillatory elements, as their name indicates, permit relative horizontal movement between the structure and the foundations which are embedded in the ground and, consequently, follow all the displacements thereof. Friction is for practical purposes removed by the transfer of structural stresses to the foundations through a fluid that is hermetically confined. This objective is attained by two methods which may be used separately or in combination. FIGS. 4 and 5 show them in combination, so that in case one of them fails, the other can assume by itself the operation of both.

In the first confining method, see FIG. 5 especially, fluid 9 is held within a hollow cylinder 10 which is closed on its upper portion. Pipe 11 fits into cylinder 10, and is supported by plate 12 through retaining ring 13 and packing 14. The structural weight that is transferred to cylinder 10, divided by its horizontal area in contact with fluid 9, determines the fluid pressure applied by it to all of the retaining surfaces, as a result of which, the weight is transferred to the plate 12 via liquid 9. In its vertical component, the area of pipe 11 which is subject to the pressure of liquid 9 is larger on its upper portion than on its lower, since the area of ring 13 that is in direct contact with plate 12 must be subtracted from the corresponding area of seal 14. Therefore, pipe 11 undergoes a downward thrust that is equal to the area differential multiplied by fluid pressure. The result is in turn multiplied by the friction coefficient of the materials in contact, rings 13 and 14 on plates 12, setting thereby the horizontal force which determines the acceleration transferred to the support when there is horizontal movement of the foundation, according to the formula: F=MA".

At seismic speeds, friction between the fluid and the plate is insignificant and can be ignored. Since the downward thrust is directly transmitted to plate 12 through rings 13 and 14, the horizontal force which determines the lateral force applied to the horizontal displacement elements 5 when there is a lateral foundation movement, will be said downward thrust multiplied by the friction coefficient between plate 12 and rings 13 and 14. In case of a possible flaw, the packing 14 would be pushed by the pressure towards the flaw and would seal same, preventing thereby any leaks. The horizontal thrusts of fluid 9 on cylinder walls 10 and on pipe 11 determine equal forces to their inner radii multiplied by the pressure. In order to balance them, it is necessary to give their walls a section that is equal to the resulting force divided by the permissible fatigue of the materials of which they are made. A line having only one dimension, there will be no surface to which to apply pressure, and therefore retaining ring 13 could theoretically have a contact area of 0, increasing its thickness progressively until at the lower level of the pipe (where thrusts are transferred thereto) its resistance is sufficient to withstand the shearing stress and the bending moment caused by the pressure of fluid 9.

Plate 12 has a double function; to present a smooth contact surface to the retaining ring 13 and seal 14, and to transfer the pressures it receives to the foundations, either directly or through a column. Its radius shall be such that it allows the maximum foreseeable seismic displacement of the foundations without letting the retaining ring come out of contact with its surface.

In summary, the only friction force that must be taken care of is that resulting from the multiplication of said downward thrust by the coefficient of friction of the contacting materials. This friction force is the only horizontal force that can be transferred to the structure by plate 12. During an earthquake, the structure will try to remain in its original position according to Newton's Law of gravity. Any force applied to it will provoke an acceleration (A=F/M). Since the mass and the horizontal force remain constant, so will the acceleration transferred to the structure. Therefore, all ground accelerations greater than that that can be transferred will be filtered and the foundation will slide underneath the structure.

Figure 18:
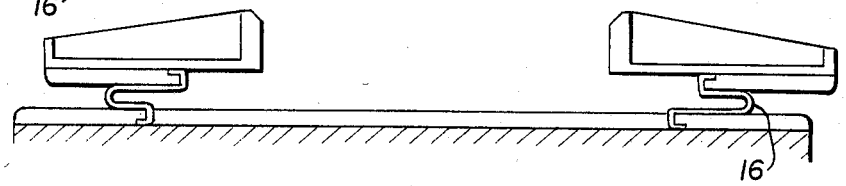
Figure 19:
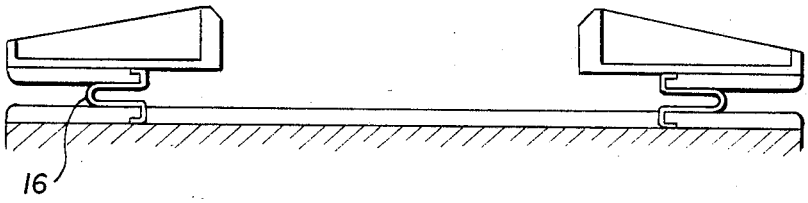
Figure 20:
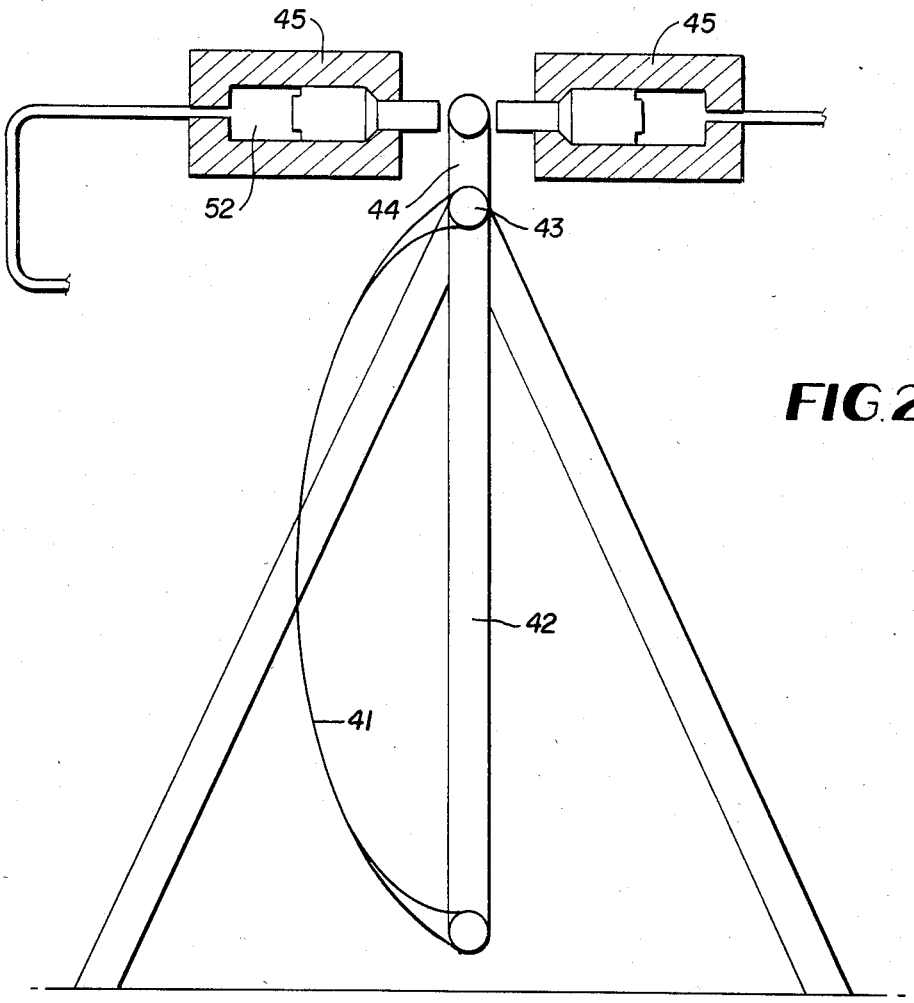

The second method confines another fluid 15 between the structure and the foundation by means of a perimetrical member 16 fastened on its upper portion to column head 17 and on its lower portion to the foundation 2, using upper and lower shaping plates 18 and 19, respectively (FIGS. 4 and 5). Perimetrical membrane 16 can be thought of as having the shape of an automobile tire positioned horizontally. Tangential forces on any circular surface are determined by their radius multiplied by the pressure. In their normal position (FIGS. 4, 5 and 18), the radius of each membrane 16 is the same all around its outer perimeter, and thus tangential forces are mutually balanced. They will remain equal during an earthquake, if shaping plates 18 and 19 are parallel. However, it may be desirable in certain cases to create lateral forces which tend to return the structure to its original position with regard to the foundations. On the contrary, depending on the magnitude of relative displacement, if desired, it shall suffice to give plates 18 and 19 certain slopes, so that opposite radii of the membrane on the axis of movement become unequal (FIGS. 25, 26, 27 and 28). Both confinement methods allow for the correction of differential sinking of the ground, injecting fluid into them or ejecting it out of them through valves 20 and 21, respectively.

Figure 1:
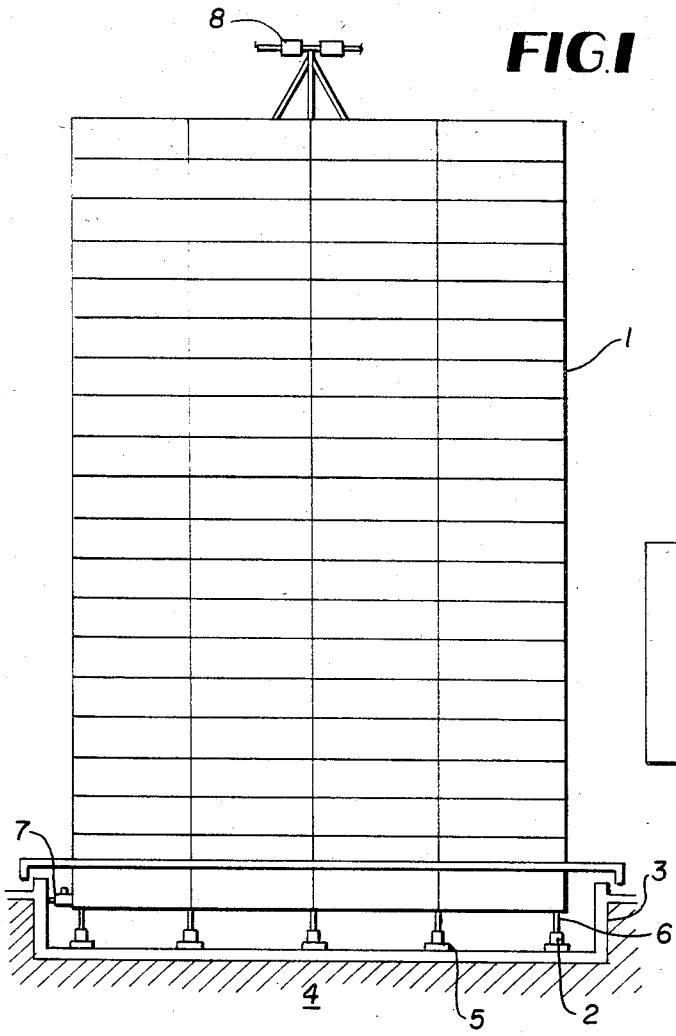
FIG. 1 is a schematic vertical elevational view of a structure showing the general location of the component elements of the invention anti-seismic system.
Figure 3:
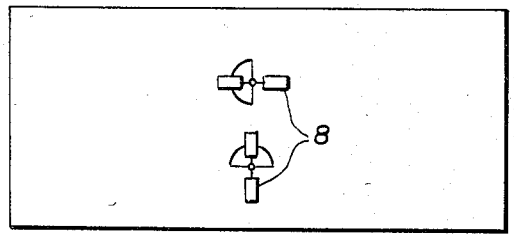
FIG. 3 is a plan view of the roof.
Figure 2:
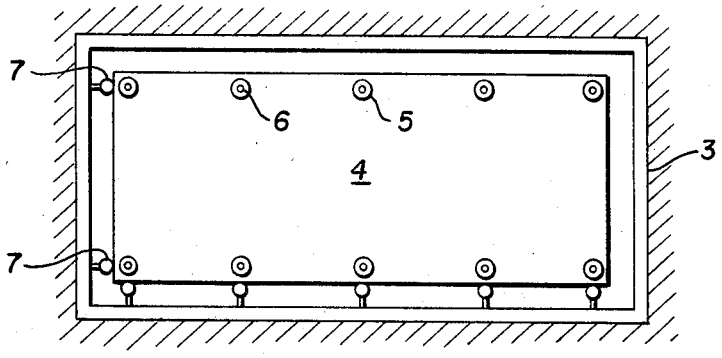
FIG. 2 is a schematic partially sectional basement plan view thereof.

Vibratory elements 6, see FIGS. 1 and 4, are basically equivalent to hydro-pneumatic jacks. However, besides performing their ordinary function of transfering structural stresses to the oscillatory elements; they carry out the following operations: during an earthquake, they permit relative vertical displacement between the cylinder and the piston, dampening the accelerations which are transferred to the structure; they prevent such vertical displacement when total load fluctuates due to increases of live load or to moments which tend to topple the building caused by winds; they return the piston to its original position with respect to the cylinder immediately after the up and down movements caused by an earthquake; and they correct for differential sinking of the ground, raising or lowering the piston and consequently the structure, as needed.

Figure 16:
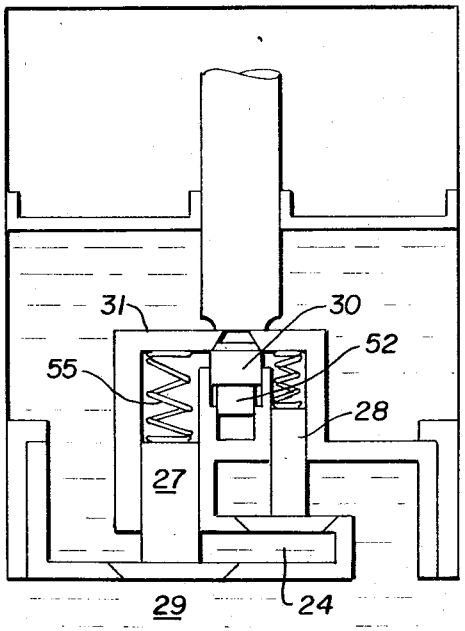
FIG. 16 shows the shutoff valves locked in by the plugging of the orifice that communicates liquid within the valve chambers with that of the surge chamber.
Figure 15:
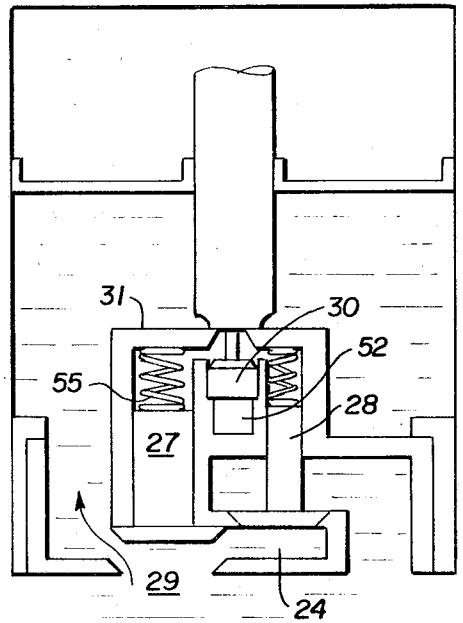
FIGS. 14 and 15 show the liquid interflow allowed by the actuation of the vibratory element valves when the piston goes down and goes up, respectively.
Figure 14:
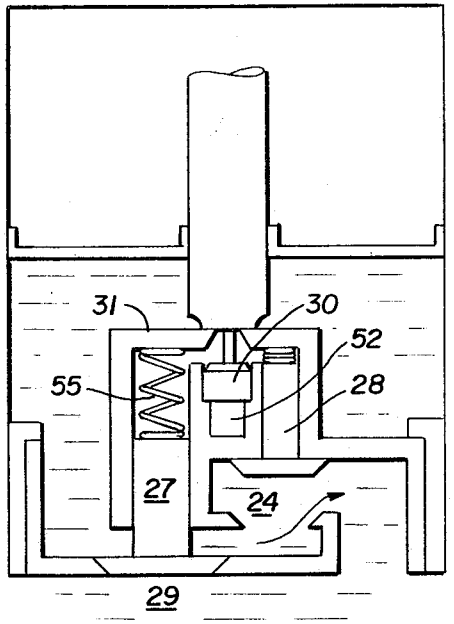
Figure 17:
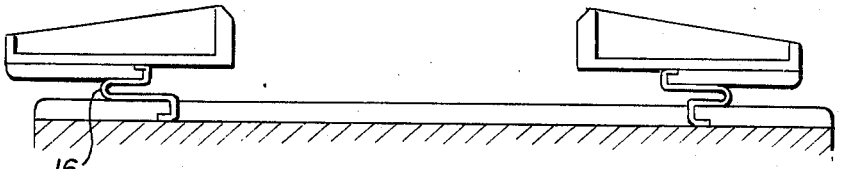
FIGS. 17, 18 and 19 show relative lateral movements between the structure and the foundations, as well as the winding of the perimetrical membrane.

The vibratory elements consist of a hollow cylinder 22 in which a piston 23 can move, the inside of same (surge chamber) being filled with a liquid 24 and a gas 25 separated by an anti-evaporation plate 26 which goes up and down according to the liquid level. Shutoff valves 27 and 28 allow, see FIG. 6, under certain seismic conditions, the flow of liquid to and from the cylinder. They are pistons which are wider or have an extension at their base, in the form of truncated cones which seat on mating orifices at the base of the piston 23 to seal these orifices hermetically. In this position (FIGS. 4, 6 and 16) there is a differential in the areas exposed to liquid pressures in the areas 24 and 29. If the pressure of liquid 29 increases, the mating orifice prevents valve 28 from opening, and valve 27 is unable to move until the area exposed to this liquid 29, multiplied by its pressure, is higher than the force resulting from the area of valve 27 exposed to liquid 24 multiplied by its pressure, provided that valve 30 is not sealing orifice 31. A reverse process occurs with valve 28 if the pressure of liquid 29 decreases, that is, valve 27 will open up to allow the flow of liquid 24 towards liquid 29. Once valve 27 or valve 28 is opened, the necessary increase to keep it that way is only that which is required to counteract the force of springs 55, which will close the respective valve as soon as the pressure of the two liquids become equal. Up to certain atmospheric conditions, valve 30 shall be forced to remain against its base by the pressure of liquid 24, but when the intensity of the wind is such that the pressure generator driven by the wind 8 causes a higher pressure than that of such liquid, as described below, the piston of valve 30 shall be driven towards orifice 31, plugging it and confining the fluid hermetically within the chambers that accommodate the pistons of the shutoff valves, thus preventing movements thereof, regardless of the magnitudes of pressure increases of liquid 29. Consequently, the horizontal surface area ratio of the shutoff valves 27 and 28 is a function of the percentage of pressure change in the liquids due to variations in live loads and any moment tending to topple the building before valve 30 starts to operate.

That is, operation depends upon the piston area and on the characteristics of each structure as to its use, height, base and weight. Under the vibratory action of an earthquake, the pressure increase of liquid 29 multiplied by the base areas of the piston will produce a force that will become the vertical acceleration transferred to the structure. This force can be made to exceed the necessary level to open up the shutoff valves, taking advantage of the fact that the most intense displacement of an earthquake takes place when its speed is equal to zero, and carrying out the following procedure: calculating the diameter of the orifices, taking into account the maximum foreseeable seismic speed in order to determine the volume of liquid which must go through with a controlled pressure fall toward the surge chamber 25 with such a capacity that its volumetric change caused by the displacement of liquid to and from the cylinder permits this flow without requiring, in turn, a pressure increase higher than the desired limit.

Figure 6:
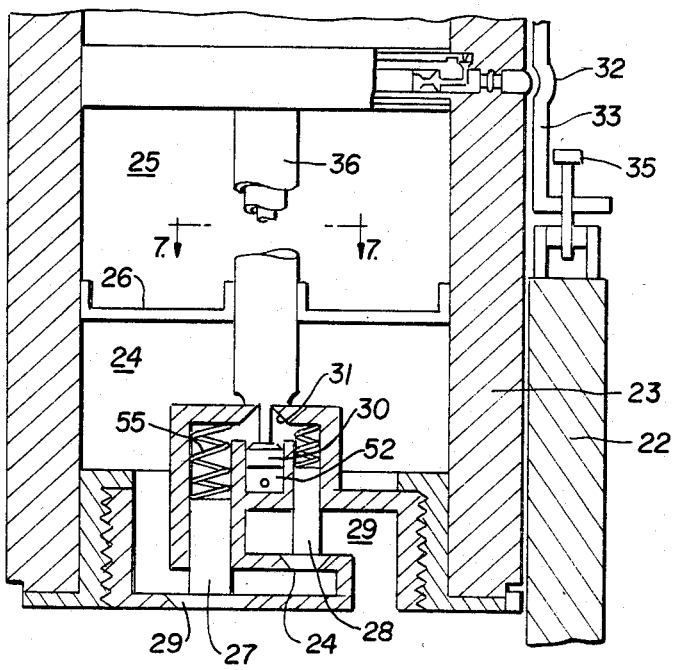
FIG. 6 is a detail of the vibratory element.
Figure 7:
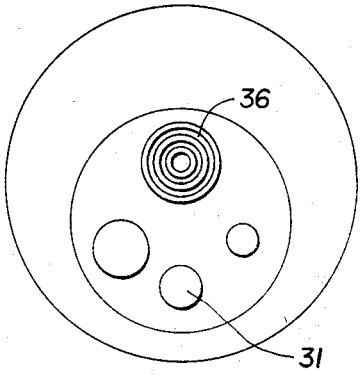
FIG. 7 is a view looking in the direction of arrows 7—7 of FIG. 6.

During construction, the structure weight will increase progressively and valve 32 will remain open to communicate liquids, thus establishing a flow towards the surge chamber as a result of the displacement of piston 23 which, upon its automatic movement, shall actuate, through valve skirt 33, see FIG. 6, valve 32 which will inject gas from an external source or from an integrated reservoir 38 to the vibratory element, as shown in FIG. 4, until the original level is recovered. When the structure is completed and in normal use, valve 32 will be controlled by skirt 33 which will close it down when the piston is at its assigned level. If an earthquake causes the necessary accelerations to open up the shutoff valves 27 or 28, the relative level between the piston and the cylinder will vary and the skirt will open up valve 32 until the piston returns slowly to the level that existed before the earthquake. By means of screws 35, the level at which the skirts stop the flow between the two liquids may be changed at will, allowing the releveling of the whole structure by injecting or ejecting liquid to or from the cylinder through valve 32.

Wind Driven Pressure Generator

Figure 22:
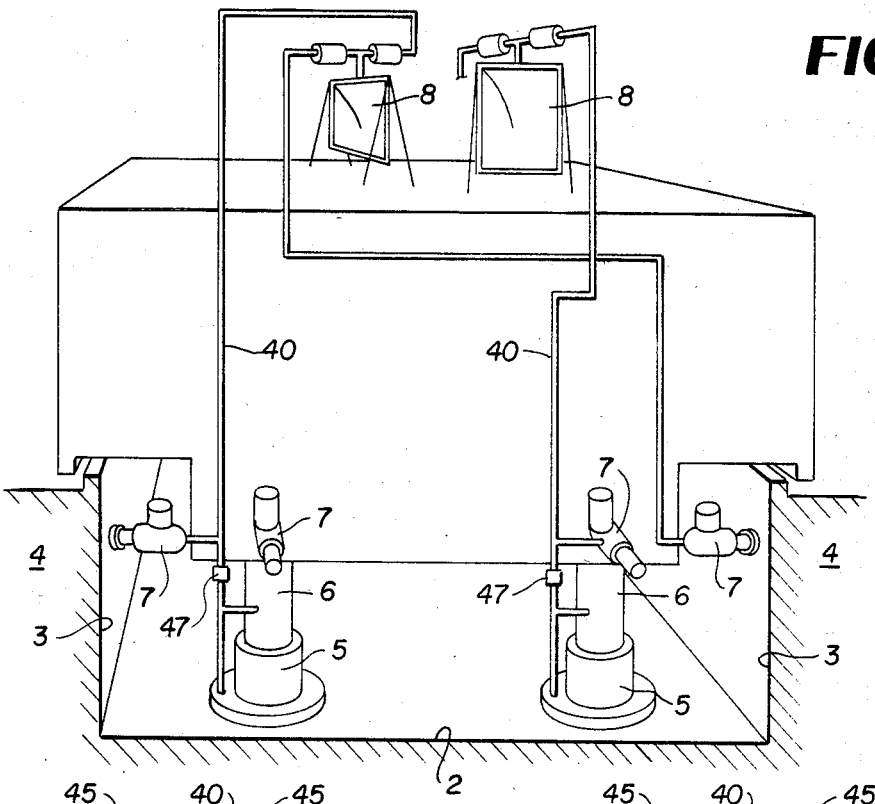
FIG. 22 is a cross-section of a structure showing the lines which communicate the pressure generator with the vibratory and friction elements, as well as with the hydro-pneumatic jacks.
Figure 23:
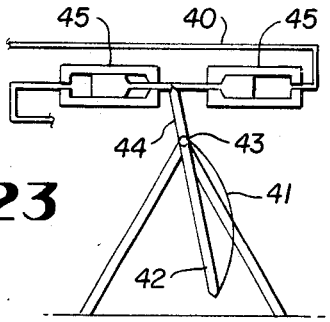
FIGS. 23 and 24 show the pressure generator's operation according to the direction in which the wind blows.
Figure 24:
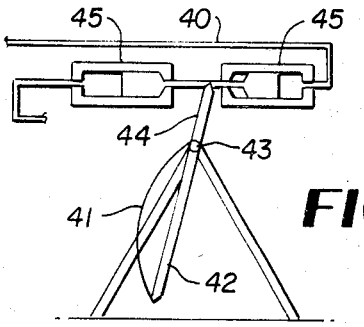
Figure 25:
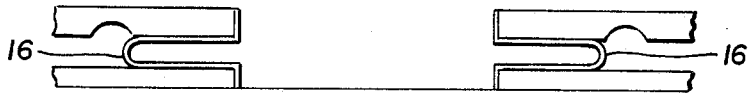
FIGS. 25, 26, 27 and 28 show relative displacements and the shaping plates making opposite radii of the perimetrical membrane unequal.
Figure 26:
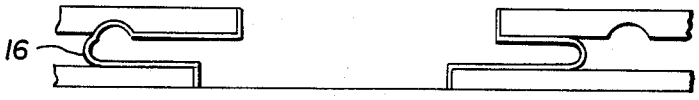
Figure 27:
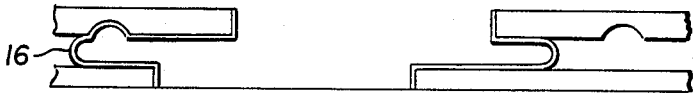
Figure 28:
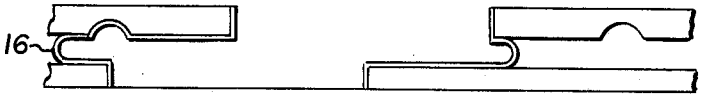

This element, see FIGS. 20–24, takes advantage of the force of the wind to counteract its own thrust. It generates hydraulic pressure on a liquid 52 which is transferred through lines or conduits 40 to the vibratory elements, to the friction elements and to the hydro-pneumatic jacks 7. It comprises a sail 41 fastened to a frame 42 which can rotate around an axle 43 that is fixed to the structure. On the opposite side of the sail and axle 43, the frame has a lever arm 44 in contact with the pistons of two hydraulic jacks 45 which are also fixed to the structure, located on opposite sides of lever 44 and generally perpendicular to the frame axle, so that one only of the two jacks 45 will be actuated when the wind blows (except when the wind blows precisely in the direction of the axle 43). The overturn tending moment caused by the action of the wind on the sail is balanced by the force of the jack, multiplied by its leverage. This force, divided by the piston area, produces the generated pressure. The piston area will depend on the volumes of liquid that are displaced when valves 30 go up in the vibratory elements and when friction rings 46 go down, as well as on their number and on the maximum permissible angle of inclination of the sail frame. The jacks 45 are connected to opposite jacks 6 and 7, as shown in FIG. 22. Each structure requires a minimum of two pressure generators with their sails parallel to the main facades; i.e., with their axles 43 perpendicular to each other in the case of rectangular plans, see FIG. 22. Each jack 45 is connected directly to a respective group of parallel hydro-pneumatic jacks through a check valve 47 and to all of the respective vibratory and friction elements.In this way, the non-wind related pressures that reach such elements normally will be higher than that produced by any of the wind generators. But the wind generated pressure reaching the elements 6 and 7 will be only that created by their respective generator. The wind generated pressure force is delivered to elements 6 and 7 by fluid 52 in conduits 40, as described in further detail below.

Hydro-pneumatic Jacks with Surge Chamber

The removal of friction between the structure and its foundations has the result that any external force can move the structure. These elements will prevent displacements by wind thrusts, but they will allow relative displacements between the structure and its foundations in the event of an earthquake or an explosion.

No construction regulations provide that the calculus of earthquake and wind effects be made simultaneously, probably based on the fact that they do not take place at the same time due to causes that are unknown. Up to this time, no case of these phenomena happening simultaneously has been known to occur. However, this invention solves the problems which would result from an earthquake with winds taking place using hydro-pneumatic jacks with surge chambers.

Figure 8:
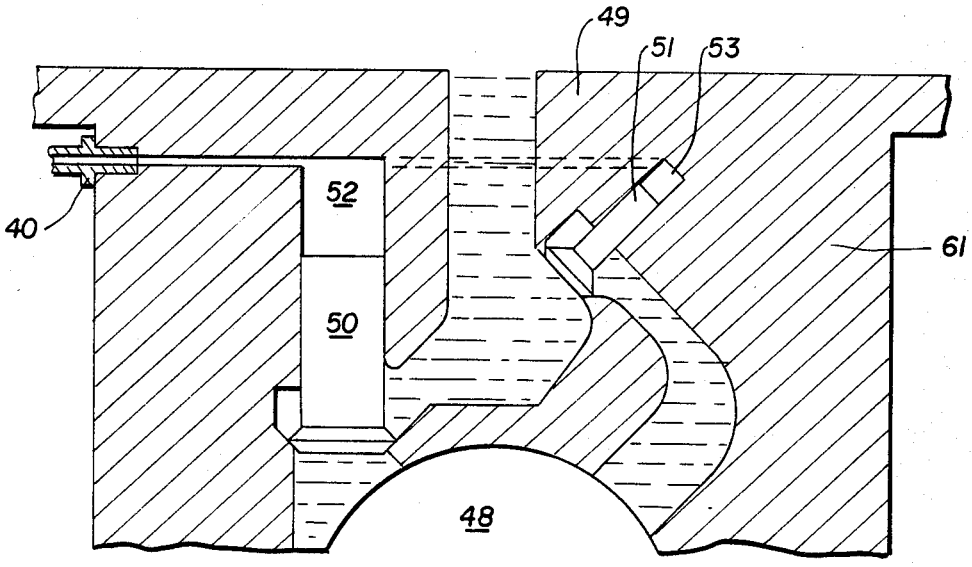
FIG. 8 is cross-sectional detail of part of a hydro-pneumatic jack.
Figure 9:
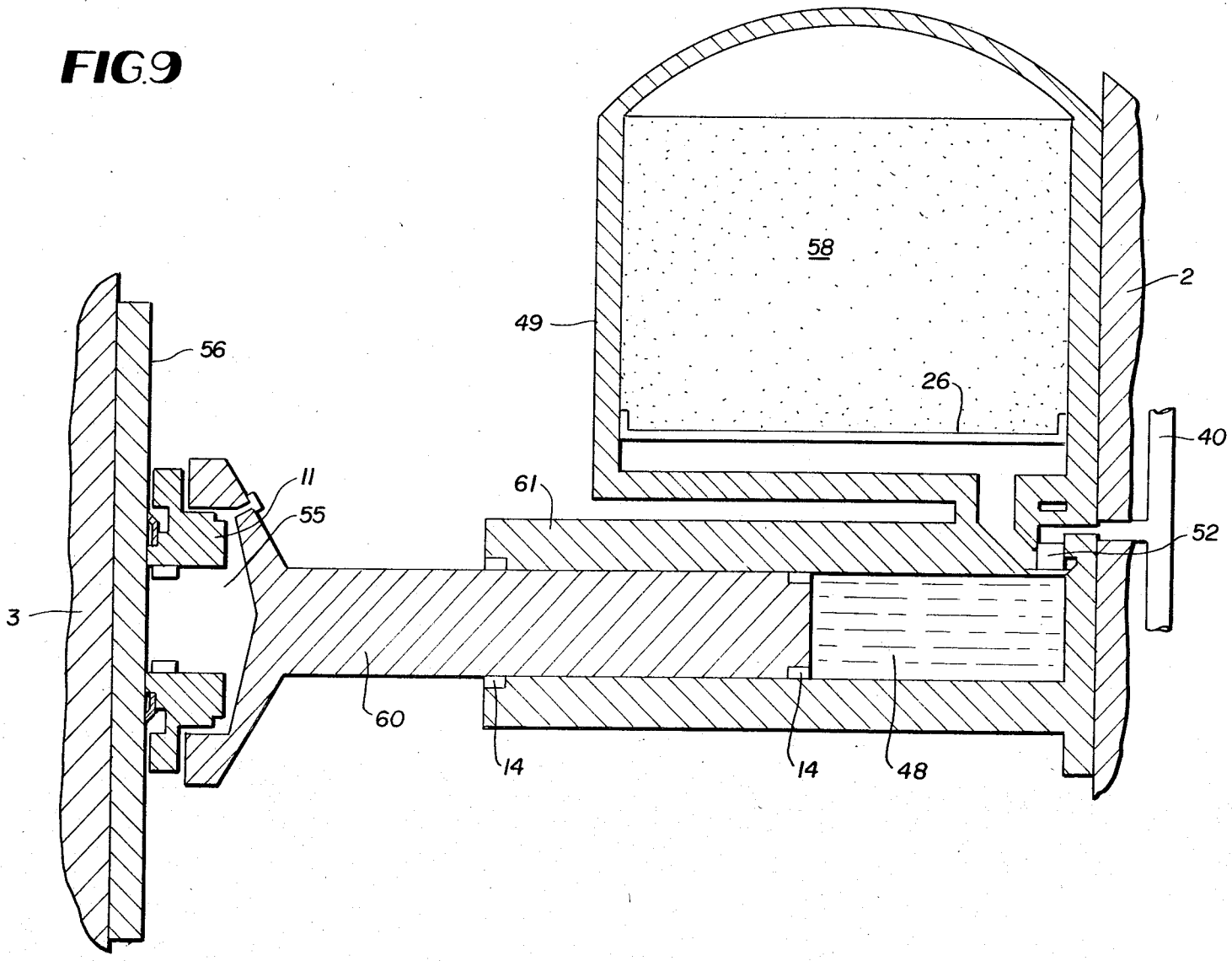
FIG. 9 is a longitudinal section of a hydro-pneumatic jack.
Figure 11:
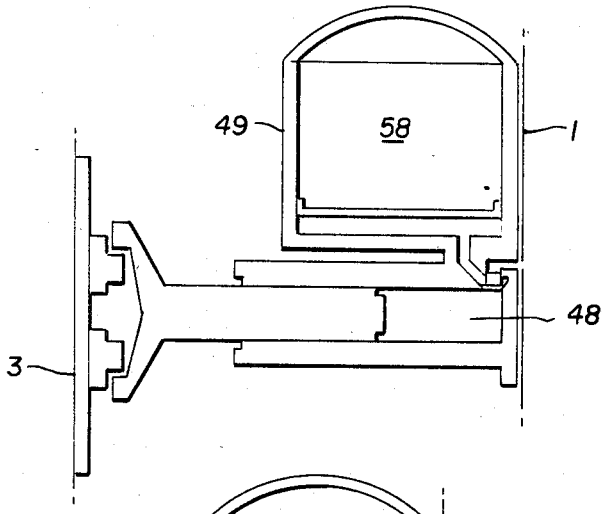
FIGS. 11, 12 and 13 are longitudinal sections of a hydro-pneumatic jack showing relative displacements between the structure and the foundations.
Figure 12:
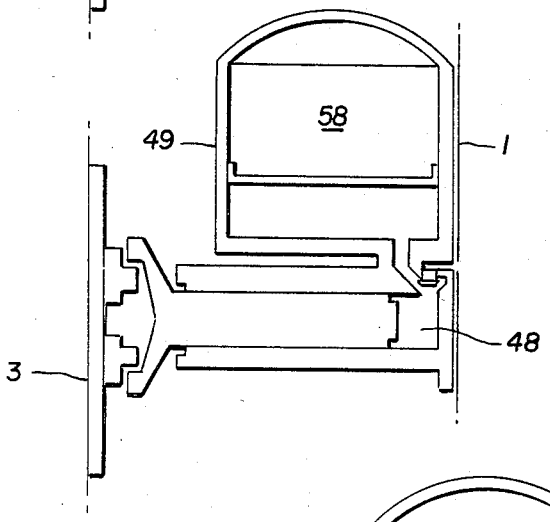
Figure 13:
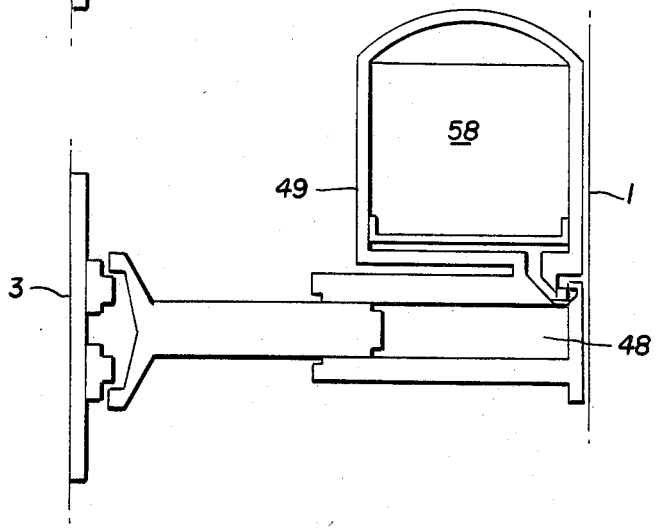

As in any other jack, referring to FIGS. 4 and 8, the jacks of this invention consist of a cylinder 24 and a piston 23, but the latter are internally connected with a surge chamber 49 through valves 50 and 51 (see FIG. 8) which regulate flow to and from the surge chamber.

The jacks are attached to the structure 1 by means of their cylinders 24 in rows that are perpendicular to the plan of the structure facades. Referring to FIG. 4, piston 60 is in contact with plate 56, which is fixed to the retaining wall 3 through a liquid 55, the fluid tightness of which is achieved by a retaining ring as in the oscillatory element. The transfer of forces through the liquid permits relative displacement between piston 60 and plate 56 on a plane perpendicular to the jacks's axis, in view of which the jack always receives thrusts concentrically.

Valve 50 (see FIGS. 8 and 10) is subject to the pressures of liquid 52 in space 48 from pressure generator 8 on its opposite ends. In a windless condition, the generator 8 will not create any pressure, and consequently the pressure of liquid 52 will result only from the height of its column. The original pressure of gas 58 should be high enough to keep valve 50 open and therefore to make the pressures of gas 58 and liquid 48 equal.

Under wind conditions, pressure generator 8 increases the pressure of liquid 52 in proportion to the thrust of the winds on the facades via the sails 41, as described above. Furthermore, liquid 52 in space 48 does not undergo any thrust into the force generated by the wind is higher than the total horizontal static friction force. When the pressure of liquid 52 exceeds that of gas 58, valve 50 is driven against the corresponding wind, stopping the flow of liquid 52 into space 48, and since valve 51 remains closed by the action of the liquid in space 53, liquid 52 in space 48 is confined and the structure is motionless.

Should earthquake and wind occur at the same time, seismic displacements acting on pistons 60 will create pressure increases on liquid 52 in space 48, and when they reach a high enough level, they will open up valve 50 to allow flow towards surge chamber 49. Liquid 52 in space 48 will maintain a higher pressure than that of remaining liquid 52 during all the time of such flow.

In a seismic displacement in the opposite direction (where foundations move away relative to the building), liquid 52 in space 48 will have its pressure reduced and valve 51 will open up to allow flow towards the jack. In order to keep the piston against plate 56, the original pressure of gas 58 should be such that even at its maximum volumetric expansion, sufficient force is maintained on the piston to prevent its separation from plate 56.

Friction Elements

These elements, the same as the hydro-pneumatic jacks with surge chambers, prevent winds from moving the structure. Therefore, either of them may be applied or they can be used in combination (FIG. 4). They comprise a ring 46 within the outside circular channel of cylinder 10 of the oscillatory element (FIGS. 4 and 5) subjected to the pressure of liquid 52 in conduit 40 from the pressure generator.

On its lower portion, the ring carries downwardly extending friction material 68 which, under normal circumstances, remains slightly separated from plate 12 by the action of the springiness of the flexible projection 57 of ring 46 which is normally supported on an outwardly extending ledge 70 formed on pipe 11. As a result of increasing winds, the wind generator 8 creates axial thrusts on ring 46, which overcome the spring force of extension 57 and will cause material 68 to contact plate 12. This contact force, multiplied by the friction coefficient between the two materials will determine the resistance to any movements between the plate 12 and the oscillatory element. Therefore, the thrusts of total winds on the structure, divided by the corresponding pressure created by the generator 8 and the total number of these elements, shall give as a result the upper horizontal area of ring 46. It if is so desired, a percentage of the wind thrusts can be assigned to these elements and the rest to the hydro-pneumatic jacks, by use of suitable expediments in the hydraulic circuits.

While the invention has been described in detail above, it is to be understood that this detailed description is by way of example only, and the protection granted is to be limited only within the spirit of the invention and the scope of the following claims.

What is claimed:

1. A seismic protection system for a structure which comprises a foundation plate with retaining walls for supporting and isolating a structure from ground;

oscillatory means between said foundation plate and the structure for permitting horizontal movement of the structure relative to said foundation plate, said oscillatory means comprising fluid confining means;

vibratory means coupled to said oscillatory means for permitting relative vertical movement between said foundation plate and the structure and for dampening and transferring structure loads to said oscillatory means;

hydro-pneumatic means with a surge chamber for permitting and controlling relative movement between the structure and said retaining walls;

friction means for preventing horizontal movement of the structure caused by wind; and wind driven pressure generating means mounted on the structure and in fluid communication with said oscillatory means, said vibratory means and said hydro-pneumatic means.

2. A system according to claim 1, wherein said fluid confining means minimizes friction during horizontal movements, and comprises a hollow cylinder coupled to said vibratory means and a cylindrical tube snugly fitted within said cylinder to function as a piston therefor, said cylindrical tube having a retaining ring of a size not greater than said cylindrical tube, and said retaining ring being in contact with said foundation plate.

3. A system according to claim 2, wherein said foundation plate has a contact surface engaging said retaining ring and transfers pressures to the ground.

4. A system according to claim 2, wherein said fluid confining means comprises a flexible perimetrical membrane attached on an upper portion thereof to a column head and on a lower portion thereof to said foundation plate by force transferring plates, said membrane having an axial length permitting flexing of perimetrical radii during horizontal movements.

5. A system according to claim 4, wherein said force transferring plates have means for shaping said perimetrical radii and thereby creating forces biasing said oscillatory means toward a predetermined position.

6. A system according to claim 1, wherein said fluid confining means comprises a flexible perimetrical membrane attached on an upper portion thereof to a column head and on a lower portion thereof to said foundation plate by force transferring plates, and said membrane having an axial length permitting flexing of perimetrical radii during horizontal movements.

7. A system according to claim 6, wherein said force transferring plates have means for shaping said perimetrical radii and thereby creating forces biasing said oscillatory means toward a predetermined position.

8. A system according to claim 1, wherein said vibratory means comprises a hydro-pneumatic jack including a hollow cylinder and a piston moveable within said cylinder and functioning as a surge chamber, said piston being filled with a liquid and a gas separated by a plate preventing liquid evaporation, and said plate being movable up and down in response to the liquid level in said cylinder.

9. A system according to claim 1, wherein said hydro-pneumatic means comprise a hydro-pneumatic jack including a piston and a cylinder coupled for relative axial movement, and said piston and cylinder being internally connected with said surge chamber through valves controlling flow to and from said surge chamber.

10. A system according to claim 9, wherein said valves are subjected to pressures of liquid confined within said hydro-pneumatic jack and of liquid pressurized by said wind pressure generating means.

11. A system according to claim 1, wherein said friction means comprises a ring mounted in an annular channel located in said oscillatory means, said ring being movable between a retracted position spaced from said foundation plate and an extended position engaging said foundation plate, said ring being biased by spring means towards said retracted position, and said annular channel being in fluid communication with said wind driven pressure generating means such that said ring will be forced against said foundation plate when fluid pressure in said channel from said wind driven pressure generating means is greater than the biasing forces of said spring means.

12. A system according to claim 1, wherein said wind driven pressure generating means comprises a sail coupled to a frame;

an axle and means for fixedly mounting said axle on the structure, said frame being rotabably coupled to said axle;

a lever extending from said frame opposite said sail; and two hydraulic jacks oriented perpendicular to and on opposite sides of said axle, said jacks being interconnected with said lever such that only one of said jacks is actuated when wind is blowing.

13. A system according to claim 1, wherein said wind driven pressure generating means is coupled to said hydro-pneumatic means by ducts arranged in parallel and is coupled to said oscillatory means and said vibratory means through a check valve.

* * * * *